United States Patent [19]

Gray

[11] 4,344,991

[45] Aug. 17, 1982

[54] WATER-BORNE TOPCOAT SPRAY METHOD

[75] Inventor: Richard L. Gray, Louisville, Ky.

[73] Assignee: Reliance Universal, Inc., Louisville, Ky.

[21] Appl. No.: 226,063

[22] Filed: Jan. 19, 1981

[51] Int. Cl.[3] ..... B44D 1/08

[52] U.S. Cl. ..... 427/325; 427/322; 427/353; 427/426; 118/315; 118/314

[58] Field of Search ..... 427/426, 353, 325, 326, 427/322; 118/314, 315

[56] References Cited

U.S. PATENT DOCUMENTS

| | | | |
|---|---|---|---|
| 1,997,874 | 4/1935 | Power | 428/474 |
| 2,414,251 | 1/1947 | Wilson | 427/326 |
| 2,811,769 | 11/1957 | Craig | 427/424 |
| 3,037,900 | 6/1962 | Hings et al. | 156/310 |
| 3,857,511 | 12/1974 | Govindan | 239/11 |
| 3,950,574 | 4/1976 | Butler | 427/424 |
| 3,979,535 | 9/1976 | Govindan | 427/422 |
| 4,007,306 | 2/1977 | Poy | 427/377 |
| 4,132,357 | 1/1979 | Blackinton | 239/11 |

*Primary Examiner*—Ralph S. Kendall
*Attorney, Agent, or Firm*—Francis H. Boos

[57] ABSTRACT

Method and apparatus are disclosed for spraying water-borne emulsion topcoat finish materials with gloss and clarity equivalent to solvent-based topcoat materials irrespective of ambient conditions. One or more secondary water atomizing sprays are positioned laterally of the primary emulsion spray nozzle to lay down a mist layer underneath or on top or, preferably, both underneath and on top of the emulsion topcoat layer to retard premature coalescence of the emulsion particles thus permitting release of air bubbles entrained in the emulsion film during the spraying process. The water mist spray is preferably not intermingled with the emulsion spray in the space between the spray nozzles and finish surface but kept close enough to the emulsion spray to avoid significant coalescence of the emulsion film before the entrained air bubbles are released.

8 Claims, 7 Drawing Figures

WATER-BORNE TOPCOAT SPRAY METHOD

BACKGROUND OF INVENTION

This invention relates to apparatus and method for spraying water-borne emulsion topcoats which are particularly useful in the furniture finishing art but also have application in other arts where water-borne emulsion topcoats are sprayed on to provide high quality surface finishes.

Currently it is common in the furniture industry to use solvent-based materials for topcoat finishes, one or more topcoats being sprayed on by skilled personnel to achieve the desired finish appearance. The topcoats are normally applied after one or more undercoat treatments have been applied in well known manner, such as stain, washcoat and sealer applications. It is important, especially in high quality furniture, that the topcoat provide a smooth, high gloss surface with excellent clarity. Solvent-based topcoat materials have been preferred for this purpose due to their consistency in imparting these and other desired characteristics to the finish surface.

One problem with using solvent-based materials is that, on drying, the solvent is released into the atmosphere as an undesired vapor causing resultant air pollution. Government regulations are being proposed that would severely limit the level of permissible solvent vapors released into the environment. In order to comply with these regulations, it would be necessary to install complex and expensive equipment to trap and remove the solvent vapors from the air. Consequently, efforts are being made to develop water-borne emulsions to be used as topcoat finishing materials in order to reduce the presence of the solvents to such an extent that the air quality regulations can be met without the need for expensive air pollution control equipment in the plant.

Although water-borne emulsions have been developed for spray-applied furniture topcoats that impart desired characteristics to the finish surface such as hardness, elasticity, resistance to water or alcohol staining and the like, one persistent problem that heretofore has not been satisfactorily resolved is the inability to consistently realize the high gloss and good clarity required for high quality finishes. In general, the water-borne emulsion topcoat has been found to impart a surface appearance that is duller and less clear than is preferred and the degree of unsatisfactory result tends to be susceptible to variations in the environmental conditions under which the spray coating is applied.

Comparative analysis of conventional solvent-based lacquers and water-borne emulsion coatings has shown that the water-borne emulsion contains a myriad of air bubbles entrained in the dried film while the lacquer is generally free of bubbles. The presence of these bubbles causes light scattering in the film which imparts a hazy and sometimes milky appearance to finish. Additionally, small pin holes resulting from air bubbles that have not completely escaped the film along with a micro-wrinkling effect result in a reduced gloss. Varying the formulation of the emulsion has not provided a satisfactory solution to eliminating these bubbles which occur as a result of entrained air caused by the spraying process.

It is, therefore, an object of the present invention to provide apparatus and method for spraying water-borne emulsion topcoats that substantially improves the clarity and gloss appearance of the resulting finish coating.

It is a further object of the invention to provide apparatus and method of spraying water-borne emulsion topcoats which is readily adaptable to existing furniture finishing processes without the need for special controlled environment conditions in the finishing area of the plant.

SUMMARY OF INVENTION

In accordance with the present invention, there is provided a method of applying water-borne emulsion topcoat finishing material to furniture surfaces and the like, namely inflexible, hard surfaces such as solid wood, wood veneers, plastics, medium density fibreboard, particle board and hardboard generally pre-finished in natural or printed wood tone or in colored enamel finishes and used in furniture and cabinet construction. The method comprises the steps of projecting an atomized spray of the water-borne emulsion toward the surface and simultaneously projecting at least one spray of atomized water toward the surface, the water spray being adjacent to the emulsion spray but so directed and so spaced therefrom as to avoid substantial intermingling of the emulsion and water sprays in the air space leading to the surface being finished. In one preferred form of the invention, a pair of water sprays are employed, one leading and one trailing the emulsion spray, to establish a water film underneath and on top of the emulsion film before significant coalescence of the emulsion particles occurs at the barrier surfaces of the emulsion film.

In accordance with a further aspect of the invention, apparatus for spraying water-borne emulsion topcoat finishing materials comprises a spray gun having a primary spray nozzle adapted to spray atomized emulsion material toward the surface and further comprises at least one secondary spray nozzle adapted to spray atomized water toward the surface. This secondary spray nozzle is attached to the spray gun and is so directed and spaced from the primary spray nozzle as to avoid substantial intermingling of the emulsion and water sprays in the space between the nozzles and the finish surface during normal spraying operation. The emulsion and water sprays should be sufficiently close to form a film of moisture on the surface of the sprayed-on emulsion film, either on top of or underneath, before significant coalescence of the emulsion particles occurs in the respective surface of the sprayed-on emulsion film. Preferably a pair of water spray nozzles are included in the apparatus disposed on opposite sides of the primary nozzle so as to form such moisture films both on top and underneath the emulsion film.

It has been found, in accordance with the invention, that spraying a water film on the emulsion film essentially simultaneously, but without significant intermingling of the sprays, retards premature "skinning" or coalescence of the emulsion particles at the respective surface of the emulsion film. As is well known, evaporation of volatiles occurs at the surface of films. The benefit of this invention results from depositing an intermediate water film on top of and/or underneath the emulsion film. It is believed that the water film on top of the emulsion film preferentially evaporates relative to the volatiles in the emulsion film thus creating a short time lag before coalescence of the emulsion particles can begin. In a similar manner, the water film underneath the emulsion film retards any wicking-in tendencies of the emulsion volatiles into the porous undersurface. The resultant time lag is sufficient to allow the entrained air bubbles to escape from the emulsion film before coalescence occurs.

DETAILED DESCRIPTION

Figure 4A:
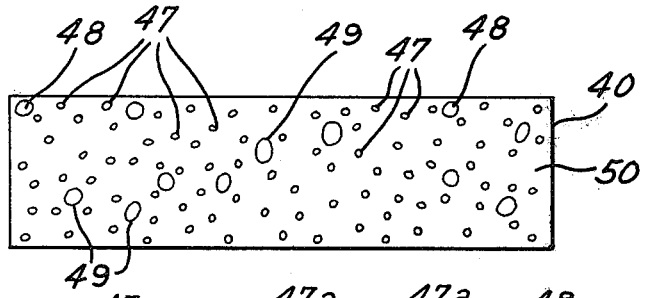
FIGS. 4*a*–4*c* are schematic representations of a sprayed-on water-borne emulsion topcoat material useful in explaining the benefits of the present invention.
Figure 4B:
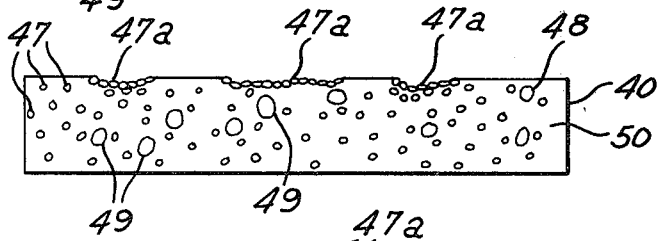
Figure 4C:
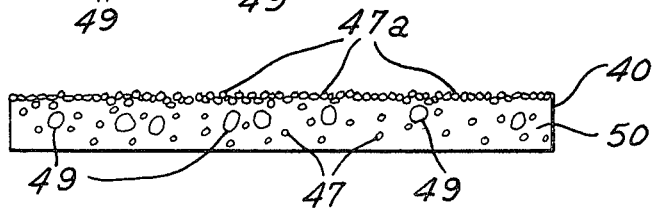

Before considering the details of a preferred embodiment of the apparatus and method of the invention, reference is had to FIGS. 4*a* through 4*c* which shows, in schematic form, three stages of the evaporative drying process of a water-borne emulsion. Thus FIG. 4*a* illustrates a sprayed-on emulsion film 40 (the substrate or finish surface not being shown) immediately after spraying and before coalescence of the emulsion particles 47 commences. By virtue of the atomized spray process, air bubbles 48 and 49 are entrained in the water and coalescent solvent carriers 50. In FIG. 4*b*, a second stage of the process is illustrated in which some of the water carrier has evaporated and the bubbles 48 near the surface have been released to the atmosphere. Coalescence of the emulsion particles 47 ("skinning") begins to occur at 47*a* due to the relatively rapid reduction in aqueous phase at the surface as compared to the interior of the film 40. This skinning can occur quite rapidly with water-borne emulsions, particularly in a relatively dry environment having a high saturation-deficit (absence of water vapor in the air). When this occurs, significant amount of water and coalescent solvent carriers 50 remain encased in the film along with the entrapped air bubbles 49 (FIG. 4*c*). As the water and coalescent solvent carriers 50 diffuse through the coalesced particles 47*a* and evaporate, the surface of the film tends to collapse irregularly resulting in a wrinkled appearance ("micro-wrinkling"). Some of the interior air bubbles 49 may pierce the coalesced particles 47*a* but the surface viscosity is now too high for reflow (smoothing) and pinholes can result. Also many of the interior air bubbles remain entrapped. The resulting overall appearance of such a film is a reduction in gloss due to surface wrinkling and pinholing and a loss of desired clarity and brilliance resulting from light defraction from the entrapped air bubbles. This condition is particularly prevalent with sprayed-on water-borne emulsions when there is a high saturation deficit in the environment since water is rapidly depleted from the emulsion spray as it travels from the spray gun to the substrate (finish surface) and also during the initial flash-off (drying) period as described above. A phenomenum similar to the skinning just described is found to occur at the bottom surface of the emulsion film and is believed to be caused by rapid absorption ("wicking-in") of the water and coalescent solvent carriers into the porous surface of the substrates or previous coatings.

Figure 1:
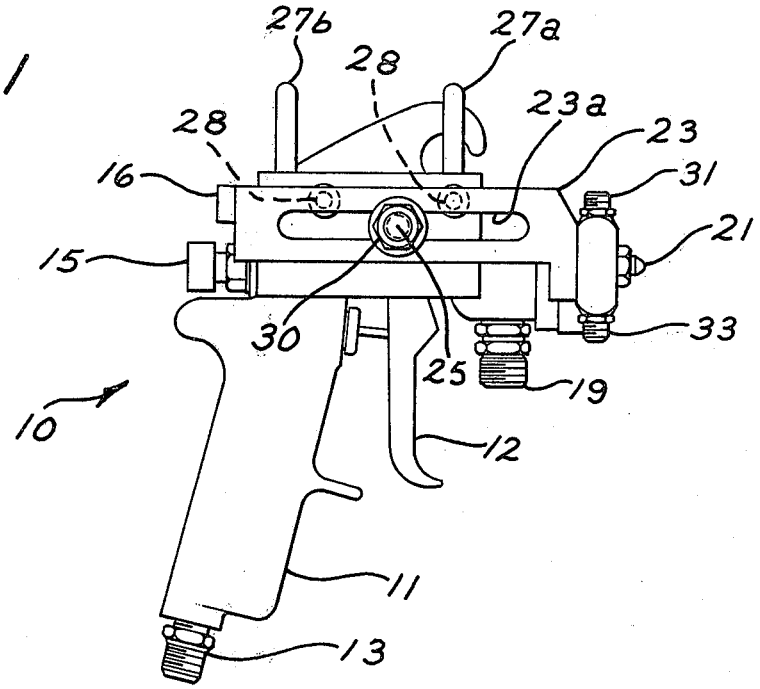
FIG. 1 is a side elevational view of a spray gun including apparatus illustrative of a preferred embodiment of the present invention.
Figure 2:
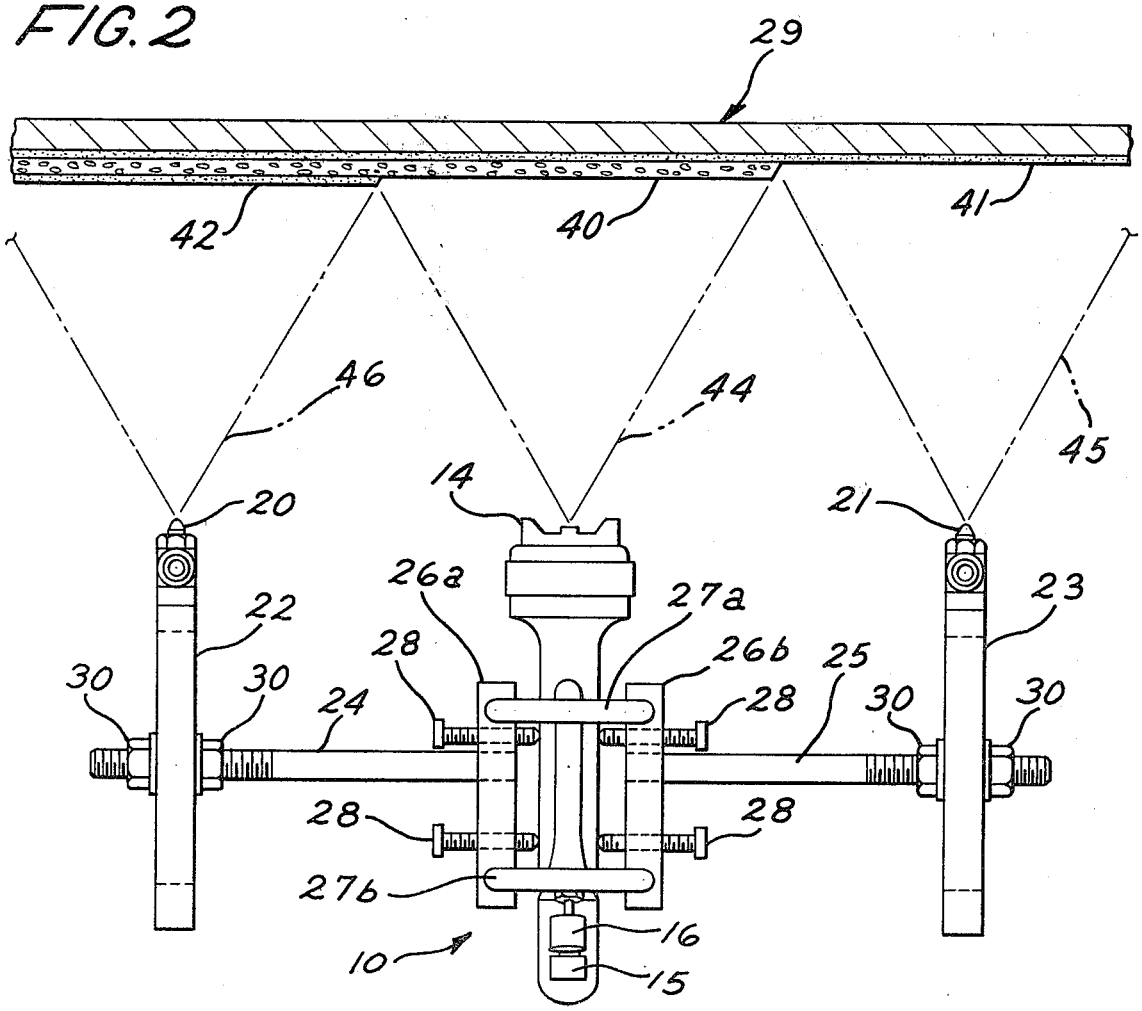
FIG. 2 is a top view of the FIG. 1 embodiment and illustrating one preferred embodiment of the method of the invention.
Figure 3:
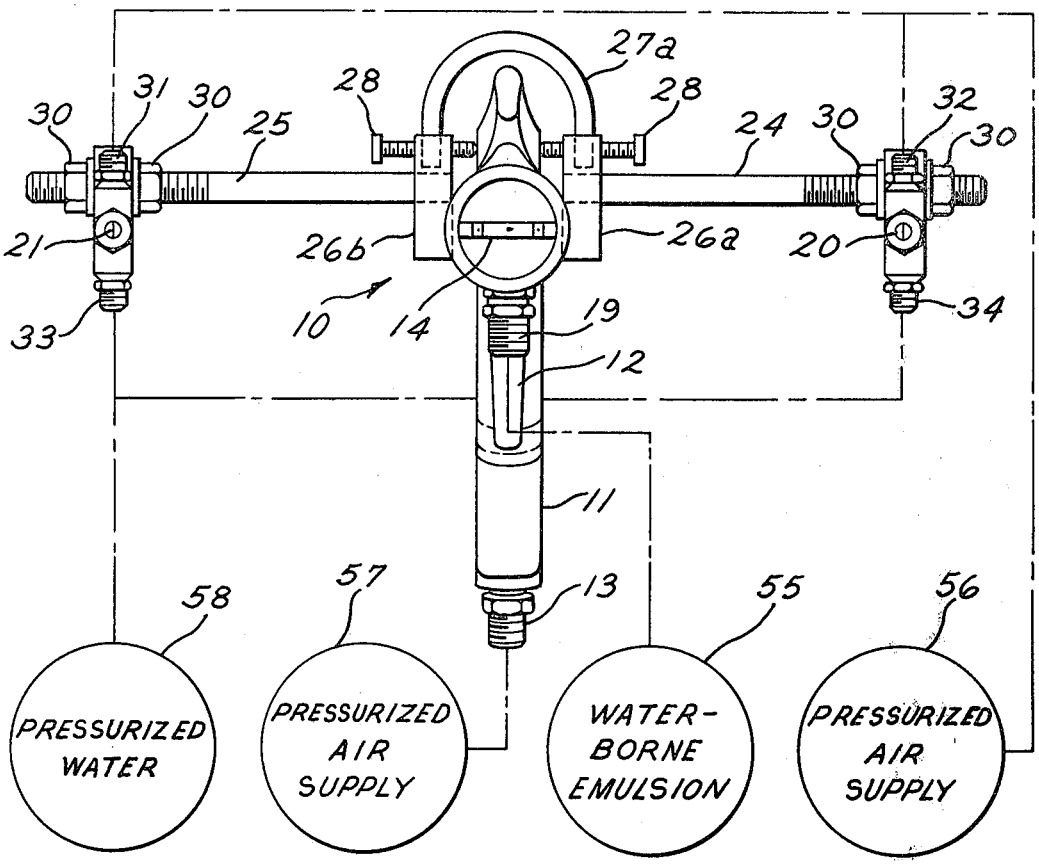
FIG. 3 is a frontal elevational view of the FIG. 1 embodiment.

Referring now jointly to FIGS. 1–3, there is shown apparatus for spraying water-borne emulsion topcoat finishing materials which includes a spray gun 10 having a primary spray nozzle 14, a handle 11 and trigger 12. Gun 10 is adapted to project an atomized spray 44 of the water-borne emulsion toward a substrate or finish surface 29 thus forming an emulsion film 40 on the surface. To this end, the gun is provided with fittings 13 and 19 to which there is supplied via appropriate hose connections, not shown, leading to a pressurized emulsion supply container 55 and pressurized air supply 57. Control knob 15 (fluid adjustment) is provided to adjust the flow rate of pressurized emulsion through nozzle hole 14*a*. Control knob 16 (spreader adjustment) is provided to adjust the flow rate of pressurized air through hole 14*b*, thereby controlling the shape of the elliptical spray pattern.

The apparatus of the invention further includes at least one, and preferably a pair, of secondary spray nozzles 20, 21 attached to gun 10 and laterally spaced from the primary spray nozzle 14. Each of the nozzles 20, 21 is secured to a slotted arm 22, 23 fitted over the threaded ends of extension rods 24, 25 and held in place by clamping nuts 30. The other ends of rods 24, 25 are attached to a mounting bracket consisting of sides 26*a*, 26*b* arranged to straddle gun 10 by means of arcuate connecting rods 27*a*, 27*b*. Clamp screws 28 are threaded through sides 26*a*, 26*b* to clamp the entire secondary nozzle assembly onto gun 10. The secondary spray nozzles are adapted to emit atomized water sprays 45, 46 aimed toward surface 29 in a direction that is preferably generally parallel to the direction of the central axis 44*a* of the emulsion spray 44. The lateral spacing of the secondary nozzles 20, 21 from primary nozzle 14 should be sufficient to avoid substantial intermingling of the water and emulsion sprays in the space between the nozzles 14, 20, 21 and the surface 29, although it will be appreciated that, in actual practice, some intermingling is bound to occur. It has been found that if the primary and secondary nozzles are too close together, the emulsion becomes severely thinned with resultant sagging of the sprayed-on film, particularly on vertical surfaces. Conversely, the primary and secondary nozzles should be close enough together so that, as the emulsion film is laid down, water films 41 and 42 are formed underneath and on top of the emulsion film 40 (using two secondary nozzles 20, 21) before significant coalescence of emulsion particles can commence. As will be seen subsequently, satisfactory results have been obtained using a single water spray, either leading or trailing the emulsion spray, however best results are realized when using the pair of nozzles 20, 21 each disposed on opposite sides of the primary nozzle 14.

In one preferred form of the invention, the secondary nozzles are positioned on opposite sides of the primary nozzle on a line passing through the extended central axis 44*a* of emulsion spray 44, which line is also parallel to the direction of relative movement between the surface and the spray gun. By virtue of the slots in the mounting arms 22, 23, the front-to-back position of the secondary nozzles 20, 21 can be adjusted to any desired setting. Means for supplying water to nozzles 20, 21 includes fittings 33, 34 which are adapted to be connected via hose line (not shown) to a pressurized water source 58. Similarly, fittings 31, 32 are adapted to be connected to pressurized air supply 56 via a separate hose line (not shown).

The following examples illustrate the manner in which the method of the invention may be practiced. In each example, a red oak panel was prepared conventionally, using undercoat processes well known in the furniture finishing art, following which the panel was cut in two. Three coats of the water-borne topcoat finish material were then spray applied to both panel halves, in one case without the secondary water spray and in the other case with the secondary water sprayed on during the topcoat spray application. The composition of the topcoat materials used in each test sample are shown in Table I as follows:

TABLE I

| Water-borne Topcoat Composition: | % Wt. |
|---|---|
| Topcoat "A": | |
| Rhoplex WL-93 (Rohm & Haas) | 64.16 |
| Deionized Water | 8.83 |
| Butyl Cellosolve (Union Carbide) | 13.25 |
| Santacizer 160 (Monsanto) | 1.66 |
| Byk 301 (Byk-Mallinckrodt) | 0.06 |
| Paint Additive 14 (Dow Corning) | 0.06 |
| Deionized Water | 10.63 |
| 14% Ammonia | 1.35 |
| | 100.00 |
| Topcoat "B": | |
| NeoCryl A-634 (Polyvinyl Chemical Inc.) | 82.05 |
| Deionized Water | 10.26 |
| Deionized Water | 4.21 |
| 28% Ammonia | 0.41 |
| Byk 301 (Byk-Mallinckrodt) | 0.51 |
| Deionized Water | 2.56 |
| | 100.00 |
| Topcoat "C": | |
| NeoCryl A-604 (Polyvinyl Chemical Ind.) | 99.25 |
| 7% Ammonia | 0.5 |
| 14% Ammonia | 0.25 |
| | 100.00 |

The topcoats were sanded with No. 220 paper between each coat. The topcoat drying schedule used after each spray consisted of one minute air dry in a booth with the fan on at an air flow rate of approximately 23.5 meters/min. followed by thirty minutes at ambient room temperature, then another thirty minutes at 130° F., concluding with a thirty minute cool down period at ambient room temperature.

Immediately prior to each topcoat application, relative humidity was determined using a sling psychrometer. Saturation-deficit of the environmental air was determined based on the difference between absolute and relative humidity and converting the result to grams per cubic centimeter (of moisture deficit) using a temperature related conversion chart. At the conclusion of each example, comparative visual observations were made using the naked eye and color photographs taken at 48X magnification. The latter clearly showed any existence of air bubbles in the finish surface. In all cases, the spray gun used was a DeVilbiss model JGK-501 with the primary nozzle consisting of an FF fluid tip and needle and a 765 air cap. The secondary nozzles each consisted of a ⅛JJ air atomizing nozzle using a J2050 fluid tip and J73320 air cap obtained from Spraying Systems Company. For this equipment and using the settings listed in Table II below for the spray gun and also the water and emulsion pot and air supply pressures, it was found that a lateral spacing of six inches from the primary nozzle to each secondary nozzle was satisfactory with the secondary nozzles being positioned so as to be equally spaced from the finish surface with the primary nozzle. It will, of course, be appreciated that other equipment and settings may be used, it being within the skill of the art to determine empirically the desired parameters.

TABLE II

| Topcoat Spray Examples and Environmental Conditions | | | | | | | | | |
|---|---|---|---|---|---|---|---|---|---|
| | Spray Gun | | Mist Atmzr | | | | | | |
| Ex. No. | Pot/Air Pressure (psig) | Fluid-Spreader Adjustment (Turns Open) | Pot/Air Pressure (psig) | Rel. Humid. % 1st | 2nd | 3rd | Sat. Deficit (gms/m³) 1st | 2nd | 3rd |
| (Topcoat "A"): | | | | | | | | | |
| 1. | 10/60 | 4–1½ | 28/90 | 43.0 | 42.0 | 41.0 | 18.4 | 19.6 | 20.2 |
| 2. | 10/60 | 4–1¼ | 30/90* | 46.5 | 43.5 | 40.0 | 17.0 | 18.8 | 20.5 |
| 3. | 10/60 | 4–1¼ | 38/90 | 26.0 | 26.5 | 25.5 | 18.8 | 17.2 | 16.9 |
| 4. | 10/60 | 4–1¼ | 34/90 | 23.0 | 20.0 | 23.0 | 17.8 | 19.6 | 17.8 |
| 5. | 10/60 | 4–1¼ | 34/90 | 23.5 | 23.0 | 22.0 | 17.9 | 17.8 | 19.1 |
| 6. | 10/60 | 4–1¼ | 34/65 | 23.5 | 23.5 | 23.0 | 15.3 | 15.3 | 16.7 |
| 7. | 10/60 | 4–1¼ | 34/65 | 18.0 | 19.0 | 21.0 | 22.8 | 19.9 | 18.8 |
| 8. | 10/60 | 4–1¼ | 38/65 | 27.0 | 25.0 | 26.5 | 18.5 | 20.6 | 19.8 |
| (Topcoat "B"): | | | | | | | | | |
| 9. | 10/60 | 4–1¼ | 38/90 | 27.5 | 22.5 | 26.0 | 17.5 | 21.6 | 18.8 |
| 10. | 10/60 | 4–1¼ | 30/90* | 49.0 | 51.5 | 50.5 | 13.5 | 13.5 | 14.2 |
| 11. | 10/60 | 4–1¼ | 38/90 | 48.5 | 47.0 | 46.0 | 15.7 | 17.1 | 16.9 |
| 12. | 10/60 | 4–1¼ | 38/90 | 58.0 | 53.0 | 52.0 | 11.3 | 14.3 | 14.8 |
| 13. | 10/60 | 4–1¼ | 30/90 | 30.0 | 31.0 | 31.0 | 18.9 | 19.2 | 19.2 |
| (Topcoat "C"): | | | | | | | | | |
| 14. | 10/60 | 4–1¼ | 34/90 | 48.0 | 48.0 | 46.0 | 12.8 | 12.8 | 14.1 |
| 15. | 10/60 | 4–1¼ | 38/90 | 44.0 | 40.0 | 37.0 | 15.3 | 16.9 | 18.0 |
| 16. | 10/60 | 4–1¼ | 34/90 | 46.0 | 43.0 | 42.0 | 12.9 | 14.0 | 14.7 |

*Mist atomizers not used during the first topcoat application for those panels on which misting was employed.

The observations from the results of these example tests were as follows:

EXAMPLES 1 and 2

The panels in Example 2 were laid in a horizontal position while the topcoat was sprayed allowing a relatively thick wet film build (5–6 mils). In Example 1 and all other examples, the panels were vertical and had thinner wet film thickness (2–3 mils). Comparison of the non-misted panels for these two examples showed fewer bubbles in the horizontal panel (Example 2), indicating some benefit in using thicker film builds or application to horizontal substrates which is somewhat impractical in furniture finishing due to the many vertical surfaces. On the other hand, in both examples a marked improvement from the unmisted to the misted panels was readily apparent in both gloss and clarity. In both Examples 1 and 2, the magnified photos showed a host of trapped air bubbles in the unmisted panels and a near absence of bubbles in the misted panels.

EXAMPLES 3 and 13

In each of these examples, four panels were prepared rather than two. One panel was unmisted to serve as a control. For the second panel, the mist atomizers were turned on to mist the panels just prior to each topcoat application, but were left off during the application of the topcoat. In the third panel, the atomizers were turned on to mist the panel only after each topcoat application. In the fourth panel, the atomizers were turned on to mist the panel only before and just after topcoat application. All four panels in each example showed about the same gloss, clarity and brightness. The magnified photos showed a significant amount of air bubbles in all panels that adversely affected the finish appearance. Because there was some time lag involved between each of the mistings and topcoat spray application steps, it appears that significant coalescence had commenced before the air bubbles had an opportunity to escape.

EXAMPLES 4, 5, 9 and 14–16

Each of these examples showed marked improvement in gloss and clarity from the unmisted to the misted panels. Except for Examples 15 and 16, the magnified photos showed a substantial reduction in the number of entrained bubbles in the misted versus unmisted panels. In Examples 15 and 16, although a significant number of bubbles remained in the misted panels, there was nonetheless a noticeable reduction. Also, the size of the bubbles was markedly smaller than in the unmisted panels with the result that they have less of a light scattering effect than the larger, less concentrated bubbles on the unmisted panels.

EXAMPLES 10–12

In Example 10, a marked improvement in gloss and clarity was observed, with the misted panel having a substantial reduction in the number of bubbles which were also of smaller diameter than those in the unmisted panel. An improvement in gloss and clarity of lesser magnitude was observed in Examples 11 and 12, with the photos showing the misted panels having a large number of entrained bubbles but of substantially smaller diameter than in the unmisted panels.

EXAMPLES 6–8

In each of these examples the misting spray procedure was modified as follows: the water atomizer assembly on the left side of the spray apparatus, including nozzle 20, was removed and the tubing refitted to feed the right side nozzle 21 only. In addition to the unmisted control panel, two misted panels were sprayed. The first misted panel was coated with a single stroke of the spray apparatus from left to right thus giving the effect of depositing a water mist layer beneath the emulsion topcoat layer but not on top. The second misted panel was coated with a single stroke of the spray apparatus from right to left, thus depositing the mist on top of the emulsion topcoat but with no mist layer underneath. These examples were similar in principal to Examples 3 and 13 but improved in that no significant time lag occurred between each water mist and emulsion topcoat spray step. Unlike Examples 3 and 13, a marked improvement was noted in the appearance and air bubble retention of the misted versus unmisted panel was noticeably lower. Interestingly, each of the panels with the mist beneath the emulsion showed fewer air bubbles than the panels with the mist layer on top of the emulsion, thus suggesting that the bottom mist layer probably retards any absorption or "wicking in" of the water and coalescent solvent carriers thereby slowing down the dry rate and giving the topcoat more time to release the air bubbles. Although these examples show that the benefit of the invention can be realized without misting both the top and bottom of the emulsion layer, misting both sides did tend to produce better results and is therefore considered to be the preferred method.

Figure 5:
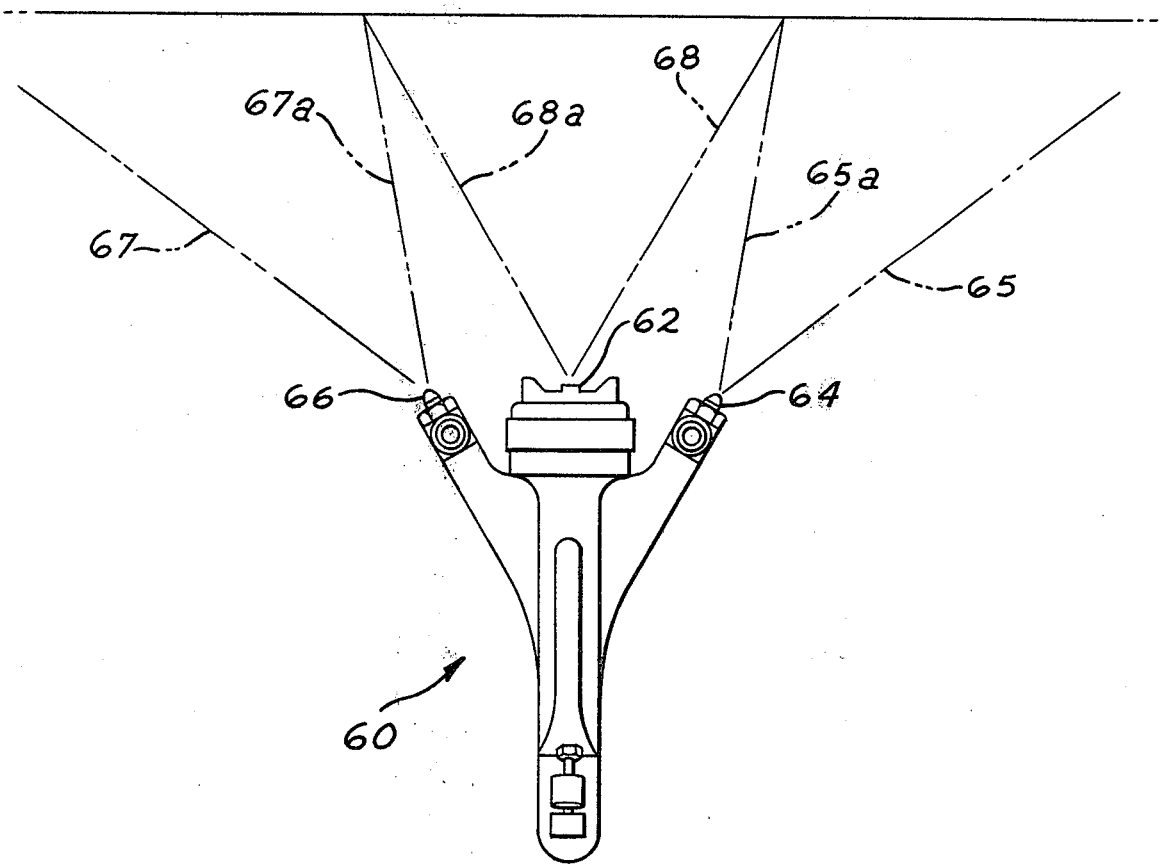
FIG. 5 is a top view of an alternative form of the spray gun apparatus of the invention.

In FIG. 5, as alternative embodiment of the invention, is shown in which spray gun 60 includes a primary emulsion spray nozzle 62 flanked by secondary atomized water spray nozzles 64, 66. In all respects the basic spray gun 60 with its primary nozzle 62 may be the same as in FIGS. 1–3 except that secondary nozzles 64, 66 are repositioned laterally and mounted on the gun 60 in close to the primary nozzle 62 and canted to provide water sprays 65, 67 having central spray axes 65*a*, 67*a*, which are divergent from the central axis 68*a* of emulsion spray 68. The secondary nozzles 64, 66 are directed and positioned so that, as with the FIGS. 1–3 apparatus, the water sprays 65, 67 are spaced away from emulsion spray 68 to avoid significant intermingling of the water and emulsion sprays while at the same time laying down moisture films of the surfaces of the emulsion film to avoid premature coalescence of the emulsion film particles.

The atomized water flow rate and air pressure settings are to some extent dependent on the saturation-deficit of the air in the spray room. There should be enough of a moisture barrier layed down to assure preferential evaporation of the moisture and retarding of evaporation of the volatiles in the emulsion film until the air bubbles have largely escaped. At the same time, excessive moisture spray should be avoided since otherwise sagging of the emulsion film results. The preferred settings are believed to be well within the ability of skilled spray personnel to determine on an empirical basis.

While, in accordance with the patent statutes, there have been described what at present are considered to be preferred embodiments of the invention, it will be obvious to those skilled in the art that various changes and modifications may be made therein without departing from the invention. It is, therefore, intended by the appended claims to cover all such changes and modifications as fall within the true spirit and scope of the invention.

What is claimed is:

1. Method of applying water-borne emulsion topcoat finishing material to furniture surfaces and the like, namely inflexible, hard wood, wood-based, or plastic prefinished surfaces the method comprising:

projecting an atomized spray of said water-borne emulsion toward the surface to be finished;

and simultaneously projecting at least one spray of atomized water toward said surface, the water spray being adjacent to the emulsion spray but so directed and so spaced therefrom as to avoid substantial intermingling of the emulsion and water sprays in the air space leading to said surface.

2. The method of claim 1 in which the longitudinal axes of the emulsion and water sprays are generally parallel.

3. The method of claim 1 in which the longitudinal axes of the emulsion and water sprays are generally divergent in the direction toward the finish surface.

4. The method of claim 1 in which the emulsion spray is moved laterally in a direction generally parallel to the finish surface and the water spray is positioned either to precede or trail the emulsion spray thereby to lay down a film of water underneath or on top, respectively, of the sprayed-on film of emulsion finishing material.

5. The method of claim 1 in which a pair of atomized water sprays are directed toward the finish surface and are disposed on opposite sides of the emulsion spray.

6. The method of claim 5 in which the emulsion spray is moved laterally in a direction generally parallel to the finish surface and the pair of water sprays are disposed on opposite sides of the emulsion in line with the direction of movement of the emulsion spray thereby to lay down a film of water both underneath and on top of the sprayed-on film of emulsion finish material.

7. Method of applying water-borne emulsion topcoat finishing material to furniture surfaces and the like, namely inflexible, hard wood, wood-based, or plastic prefinished surfaces the method comprising:

laying down an atomized spray film of said water-borne emulsion on the surface to be finished;

and leading or trailing the emulsion spray with an atomized water spray to establish a film of moisture respectively underneath or on top of the emulsion film before significant coalescence of the emulsion particles occurs at the barrier surfaces of the emulsion film.

8. The method of claim 7 in which a pair of atomized water sprays are employed, one leading and one trailing the atomized emulsion spray to establish a film of water both underneath and on top of the emulsion film.

* * * * *